US006863130B2

(12) United States Patent
Steele et al.

(10) Patent No.: US 6,863,130 B2
(45) Date of Patent: Mar. 8, 2005

(54) MULTI-LAYER DEFORMABLE COMPOSITE CONSTRUCTION FOR USE IN A SUBTERRANEAN WELL

(75) Inventors: David J. Steele, Irving, TX (US); John C. Gano, Carrollton, TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 10/348,212

(22) Filed: Jan. 21, 2003

(65) Prior Publication Data

US 2004/0140103 A1 Jul. 22, 2004

(51) Int. Cl.[7] ..... E21B 43/00
(52) U.S. Cl. ..... 166/380; 166/384; 166/207
(58) Field of Search ..... 166/384, 207, 166/277, 212, 380

(56) References Cited

U.S. PATENT DOCUMENTS

| | | | | |
|---|---|---|---|---|
| 4,982,625 A | * | 1/1991 | Bonner | 81/53.2 |
| 5,318,122 A | | 6/1994 | Murray et al. | |
| 5,330,007 A | | 7/1994 | Collins et al. | |
| 5,337,823 A | | 8/1994 | Nobileau | |
| 5,350,481 A | * | 9/1994 | Shepard et al. | 156/423 |
| 5,388,648 A | | 2/1995 | Jordan, Jr. | |
| 5,425,559 A | | 6/1995 | Nobileau | |
| 5,479,986 A | | 1/1996 | Gano et al. | |
| 5,613,557 A | * | 3/1997 | Blount et al. | 166/277 |
| 5,655,602 A | | 8/1997 | Collins | |
| 5,695,008 A | | 12/1997 | Bertet et al. | |
| 5,718,288 A | | 2/1998 | Bertet et al. | |
| 5,794,702 A | | 8/1998 | Nobileau | |
| 5,817,737 A | | 10/1998 | Mariaggi et al. | |
| 5,964,288 A | | 10/1999 | Leighton et al. | |
| 5,979,560 A | | 11/1999 | Nobileau | |
| 6,026,903 A | | 2/2000 | Shy et al. | |
| 6,056,059 A | | 5/2000 | Ohmer | |
| 6,089,320 A | | 7/2000 | LaGrange | |
| 6,189,616 B1 | | 2/2001 | Gano et al. | |
| 6,252,852 B1 | | 6/2001 | Rowles et al. | |
| 6,253,846 B1 | | 7/2001 | Nazzai et al. | |
| 6,253,850 B1 | * | 7/2001 | Nazzai et al. | 166/277 |
| 6,253,852 B1 | | 7/2001 | Nobileau | |
| 6,315,040 B1 | | 11/2001 | Donnelly | |
| 6,336,507 B1 | | 1/2002 | Collins | |
| 6,564,867 B2 | | 5/2003 | Ohmer | |
| 6,648,075 B2 | * | 11/2003 | Badrak et al. | 166/381 |
| 6,703,095 B2 | * | 3/2004 | Busshoff et al. | 428/36.91 |
| 2002/0033261 A1 | | 3/2002 | Metcalfe | |

FOREIGN PATENT DOCUMENTS

| | | |
|---|---|---|
| GB | 2275286 | 8/1994 |
| GB | 2353811 | 3/2001 |
| WO | WO 9/13195 | 3/1999 |
| WO | WO 00/26501 | 5/2000 |
| WO | WO 02/29207 | 4/2002 |
| WO | WO 02/29208 | 4/2002 |

OTHER PUBLICATIONS

U.S. Appl. No. 10/773,899, filed Feb. 6, 2004.

(List continued on next page.)

*Primary Examiner*—William Neuder
(74) *Attorney, Agent, or Firm*—Marlin R. Smith

(57) ABSTRACT

A multi-layer deformable composite construction. In a described embodiment, a method of expanding a structure in a wellbore includes the steps of: positioning the structure in an unexpanded configuration in the wellbore, the structure including a wall made up of multiple layers; expanding the structure to an expanded configuration while permitting relative displacement between the layers; and then preventing relative displacement between the layers.

80 Claims, 6 Drawing Sheets

OTHER PUBLICATIONS

Web page:www.pml.tno.nl:80/en/em/ap–welding.html, "Explosive Welding and Cladding of Metals", undated.

Web page:http://www.mdacomposites.org/materials.htm, "FRP Composite Materials: An Overview", undated.

Web page:http://www.engr.siu.edu/staff2/abrate/rtm/relate-.htm, Southern Illinois University, RTM Related Processes, dated 2000.

Web page:http://www.highenergymetals.com/, High Energy Metals, Inc. "Explosive Metalworking Experts", dated undated.

Web page:http://www.highenergymetals.com/Engineering%20and%20Design %20Basics%20Web%20Page.pdf, High Energy Metals, Inc., "Explosion Bonding Engineering snd Design Basics", dated Mar. 8, 2000.

Search Report for United Kingdom application No.: GB0401224.1.

U.S. Appl. No. 10/121,471 filed Apr. 11, 2002, entitled Expandable Float Shoe and Associated Methods.

* cited by examiner

MULTI-LAYER DEFORMABLE COMPOSITE CONSTRUCTION FOR USE IN A SUBTERRANEAN WELL

BACKGROUND

The present invention relates generally to operations performed and equipment utilized in conjunction with a subterranean well and, in an embodiment described herein, more particularly provides a multi-layer composite construction for use in a well.

It is well known to expand structures, such as screens, pipe, wellbore junctions, etc., in a well. Expansion of the structures after being positioned in a wellbore enables the structures to pass through restrictions in the wellbore, enlarge flow areas therethrough, and provides other benefits as well.

Unfortunately, an expanded structure typically has a relatively low collapse resistance. This is due to several factors. One factor is that the structure must be made weak enough to be expanded downhole. If the structure is too strong, it cannot be inflated or swaged outward using conventional expansion techniques.

Another contributing factor is that materials which have sufficient elasticity to permit them to be deformed to the degree necessary for expansion downhole are also relatively easy to deform in collapsing the structure. If the material thickness is increased to provide increased collapse resistance, then the material must withstand even greater deformation in the expansion process. In addition, greater material thickness results in a larger overall structure, which may defeat the purpose for making the structure expandable.

From the foregoing, it can be seen that it would be quite desirable to provide improved expandable structures for use in a wellbore, and improved methods for constructing and using such structures.

SUMMARY

In carrying out the principles of the present invention, in accordance with an embodiment thereof, a multi-layer deformable composite structure is provided which solves the problems in the art described above. Methods of expanding the structure in a wellbore are also provided.

The structure includes a wall made up of multiple layers. While the structure is being expanded, the layers are able to displace relative to each other. This permits the structure to be expanded without transmitting shear forces between the layers. When the structure is expanded, the layers are prevented from displacing relative to each other, thereby permitting shear forces to be transmitted between the layers, and increasing the structure's resistance to collapse.

In one aspect of the invention, a method of expanding a structure in a wellbore of a subterranean well is provided. The method includes the steps of: positioning the structure in an unexpanded configuration in the wellbore, the structure including a wall made up of multiple layers; expanding the structure to an expanded configuration in the wellbore; and bonding the layers to each other after the positioning and expanding steps.

In another aspect of the invention, another method of expanding a structure in a wellbore of a subterranean well is provided. The method includes the steps of: positioning the structure in an unexpanded configuration in the wellbore, the structure including a wall made up of multiple layers; expanding the structure to an expanded configuration while permitting relative displacement between the layers; and then preventing relative displacement between the layers.

In yet another aspect of the invention, a system for expanding a structure in a wellbore of a subterranean well is provided. The system includes the structure with a wall having multiple layers. The structure is expanded from an unexpanded configuration to an expanded configuration by initially permitting relative displacement between the layers, and then preventing relative displacement between the layers.

There may be cases where it is advantageous to "crush" or deform the structure and then bond the layers together prior to running the structure into the well. In this manner, the structure would be easier to manufacture because it would require less horsepower to deform to its compressed or unexpanded configuration. For instance, the crushed shape could be made by physically compressing/crushing or drawing.

After the layers are drawn/crushed, they could be assembled and then fastened together to prevent the layers from moving relative to one another. The downhole inflation/expansion forces would be higher, but that can be worked around by using high-pressure intensifiers (e.g., the drill pipe pressure may be increased significantly to inflate the structure downhole). The strains may be low enough that the structure can be reinflated as a structure of one wall thickness, instead of as a multilayer structure. This would eliminate the complexity of bonding or otherwise securing the layers together downhole.

These and other features, advantages, benefits and objects of the present invention will become apparent to one of ordinary skill in the art upon careful consideration of the detailed description of representative embodiments of the invention hereinbelow and the accompanying drawings.

DETAILED DESCRIPTION

Figure 1B:
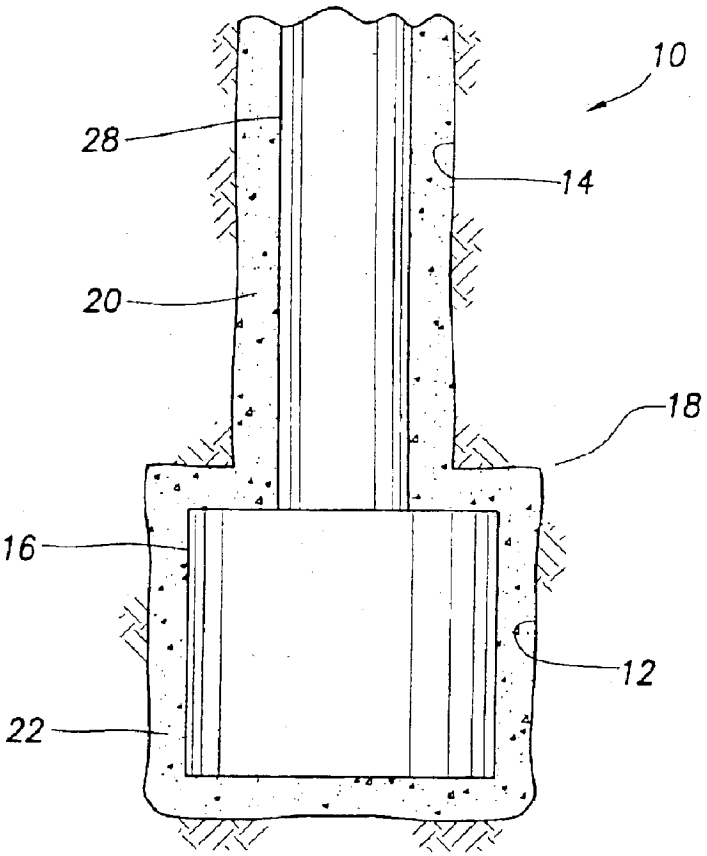
FIGS. 1A–C are schematic cross-sectional views of a method embodying principles of the present invention.
Figure 1A:
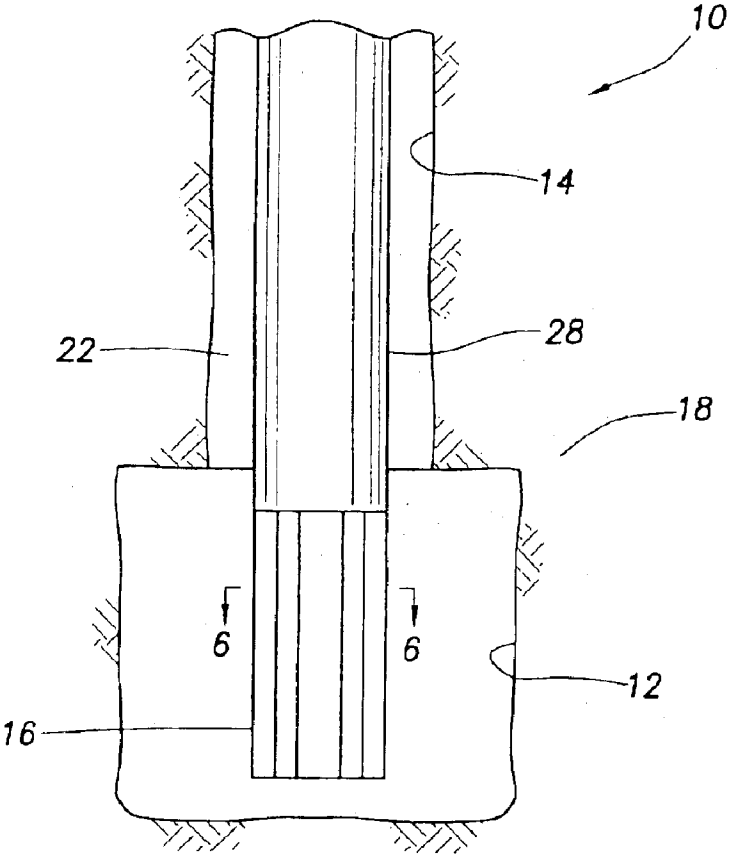
Figure 1C:
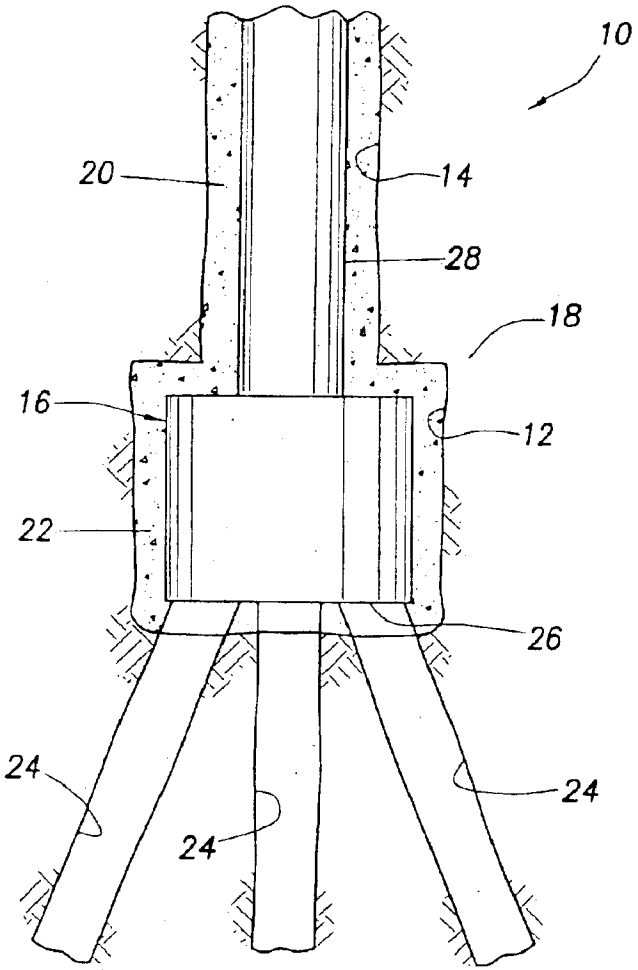

Representatively illustrated in FIGS. 1A–C is a method 10 which embodies principles of the present invention. In the following description of the method 10 and other apparatus and methods described herein, directional terms, such as "above", "below", "upper", "lower", etc., are used only for convenience in referring to the accompanying drawings.

Additionally, it is to be understood that the various embodiments of the present invention described herein may be utilized in various orientations, such as inclined, inverted, horizontal, vertical, etc., and in various configurations, without departing from the principles of the present invention.

In the method 10 as viewed in FIG. 1A, an enlarged underreamed cavity 12 is formed in a wellbore 14. An expandable structure 16 is then positioned in the cavity 12. When the structure 16 is expanded, the cavity 12 provides space in the wellbore 14 for the enlarged structure.

As depicted in FIG. 1A, the structure 16 is a wellbore junction, used to provide for drilling multiple branch wellbores extending outwardly from the wellbore 14. The structure 16 forms a protective lining for the wellbore 14 at the junction, isolating the intersecting wellbores from a formation 18 surrounding the junction.

However, it should be understood that the method 10 as illustrated in the figures and described herein is merely an example of one application of the principles of the invention, and many other uses of these principles are possible. For example, it is not necessary for the underreamed cavity 12 to be formed in the wellbore 14. It is not necessary for the expandable structure 16 to be a wellbore junction, since other expandable structures, such as tubing, casing, liner, screens, other well tools, etc., may also benefit from the principles of the invention. In short, the specific details of the method 10 are given to enable a person skilled in the art to understand how to make and use the invention, but are not to be take n as limiting the invention in any manner.

In FIG. 1A, the structure 16 is depicted in an unexpanded configuration. Preferably, the structure 16 is fabricated in an initial configuration, and then compressed into the unexpanded configuration as described more fully below. However, it is not necessary for the structure 16 to be compressed from an initial configuration into an unexpanded configuration in keeping with the principles of the invention. Instead, the unexpanded configuration could be the initial configuration of the structure 16, for example.

In FIG. 1B, the structure 16 is depicted after it has been expanded. The structure 16 may be expanded using any of those methods known to those skilled in the art. For example, pressure may be applied to the interior of the structure via a tubular string 28 to thereby inflate the structure. Alternatively, or in addition, a swaging tool may be displaced through the structure 16 to apply an outwardly directed expansion force to the interior of the structure.

Note that the expanded structure 16 has a larger outer dimension than the inner diameter of the wellbore 14, thus the desirability of forming the underreamed cavity 12 in the wellbore. However, if the structure 16 in its expanded configuration is no larger than the wellbore 14, then the cavity 12 is not needed. For example, the structure 16 could be a casing string, in which case it could be expanded in the wellbore 14 without forming the cavity in the wellbore.

Cement 20 is flowed into the wellbore 14 about the structure 16 to secure the structure in the wellbore and prevent fluid migration through an annulus 22 between the structure and the wellbore. The cement 20 may be flowed into the annulus either prior to, or after, the structure 16 is expanded. Preferably, the cement 20 is flowed into the cavity 12 at a relatively very slow rate, to prevent voids from being formed in the annulus 22 in the cavity.

To provide for cement flow through the structure 16 during the cementing process, the structure may be provided with a cementing shoe or float shoe. The shoe may be expandable, such as the shoe described in copending application Ser. No. 10/121,471, filed Apr. 11, 2002 and entitled EXPANDABLE FLOAT SHOE AND ASSOCIATED METHODS, the entire disclosure of which is incorporated herein by this reference. However, it should be understood that it is not necessary for the structure 16 to be provided with a cementing shoe, or for the shoe to be expandable if one is provided.

Upper and lower end connections (e.g., where the casing string 28 connects to the structure 16) of the structure are preferably multi-layered as well. The end connections of the structure 16 (whether they terminate or have a casing string attached to the bottom) transition from a large diameter down to a smaller diameter in the unexpanded configuration, thus this transition area will be subjected to "crushing/re-inflating" strains as high as in the main body of the structure. Note that multiple ones of the structure 16 may be interconnected in the casing string 28, and these structures may be expanded simultaneously, sequentially, or in any order desired.

Having a conduit for flow through the structure 16 is preferable not only for cementing purposes, but for circulating and well control while tripping in the hole. Likewise, the ability to run multiple expandable structures 16 on one casing string 28 will be enhanced by providing a conduit through the upper structures 16 to the lower structures.

As depicted in FIG. 1C, multiple branch wellbores 24 are drilled through a bottom wall 26 of the structure 16. To drill the wellbores 24, cutting tools, such as mills, drills, etc., are passed through the structure 16 to drill through the bottom wall 26 and into the earth below the structure. The cutting tools may be guided by deflection devices, such as whipstocks, alignment devices, etc., installed in the expanded structure 16.

Figure 2:
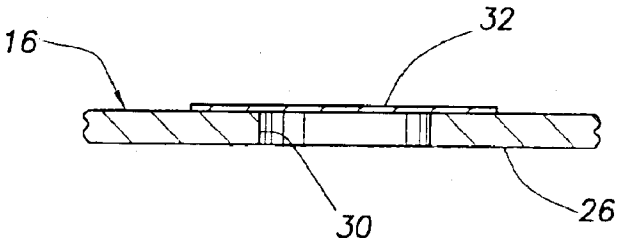
FIG. 2 is an enlarged scale cross-sectional view of a lower portion of a wellbore junction used in the method of FIG. 1.

One or more windows 30 may be provided in the bottom wall 26 of the structure 16, as depicted in FIG. 2, so that it is not necessary to mill through the bottom wall prior to drilling the wellbores 24. An easily drilled through membrane or other closure 32 may be used to prevent flow through the window 30 during the expansion and/or cementing processes. The membrane 32 is then drilled through, or otherwise disposed of, when the wellbores 24 are drilled.

Note that, although in the method 10 as described herein, the wellbores 24 are drilled outwardly from the bottom wall 26 of the structure 16, it will be readily appreciated that one or more of the wellbores could be drilled outwardly through a sidewall of the structure.

Figure 3:
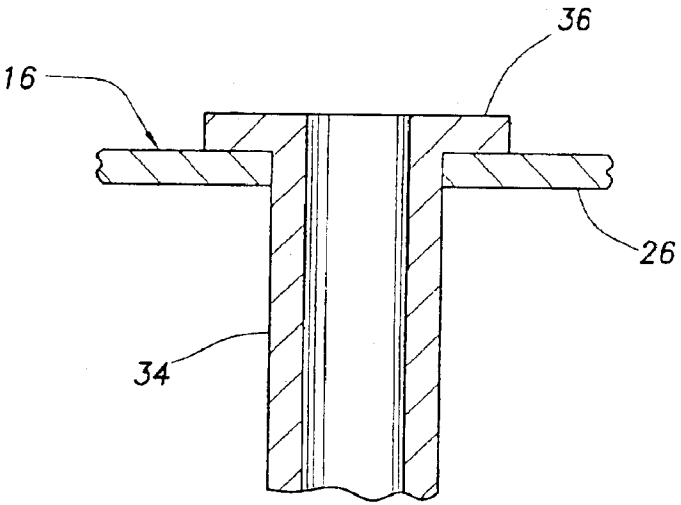
FIG. 3 is an enlarged scale cross-sectional view of a first method of attaching a liner to the wellbore junction.

To line the wellbores 24, a liner string 34 may be connected to the structure 16. Preferably, the liner string 34 is sealed to the structure 16, so that the interior of the structure remains isolated from the formation 18 surrounding the intersection of the wellbores 14, 24. As depicted in FIG. 3, the liner string 34 is provided with an outwardly extending flange 36 which sealingly engages the interior of the bottom wall 26. The seal between the flange 36 and the bottom wall 26 may be a metal-to-metal seal, or it may be provided by an elastomer or nonelastomer seal, an adhesive sealant, or any other type of seal.

The flange 36 is depicted in FIG. 3 as one method of attaching the liner string 34 to the structure 16. Other methods are described below. However, it will be readily appreciated that many alternative methods may be used in keeping with the principles of the invention. For example, the liner string 34 could be provided with outwardly extending keys or dogs which engage an internal profile of the structure 16, or the liner string could be provided with a liner hanger which is set in a bore of the structure 16, etc. A suitable liner hanger is described in U.S. Pat. No. 6,135,208, the entire disclosure of which is incorporated herein by this reference. Thus, it should be understood that the principles of the invention are not limited by the details of the specific liner string attachment methods described herein.

Figure 4A:
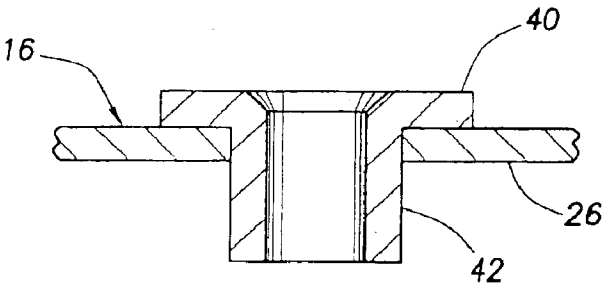
FIGS. 4A & B are enlarged scale cross-sectional views of a second method of attaching a liner to the wellbore junction.

In FIGS. 4A & B, another method of connecting a liner string 38 to the structure 16 is representatively illustrated. In this method, a flanged bushing 40 is installed in the bottom wall 26. Preferably, the flanged bushing 40 is sealed to the bottom wall 26, similar to the manner in which the flange 36 is sealed to the bottom wall as described above.

Figure 4B:
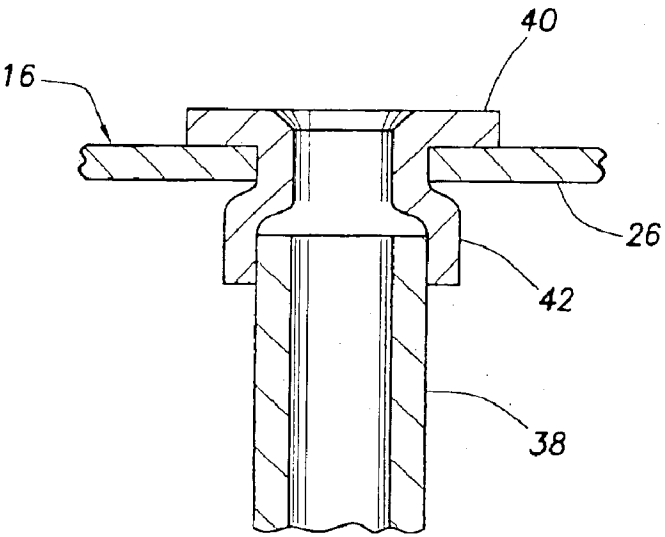

A lower tubular portion 42 of the bushing 40 extends through the bottom wall 26. After the corresponding branch wellbore 24 is drilled, the liner string 38 is conveyed through the bushing 40 and is expanded in the wellbore, as depicted in FIG. 4B. An upper end of the liner string 38 is positioned within the lower tubular portion 42 of the bushing 40 when the liner string is expanded.

Preferably, expansion of the liner string 38 also causes the tubular portion 42 to expand outward, so that an inner diameter of the expanded liner string is at least as large as an inner diameter of the bushing 40. Thus, expansion of the liner string 38 may also expand the portion 42 of the bushing 40, connect the liner string to the structure 16, and form a seal between the top of the liner string and the bushing. For this purpose, the upper end of the liner string 38 may be configured similar to the liner hanger described in the U.S. Pat. No. 6,135,208 referred to above.

Figure 5A:
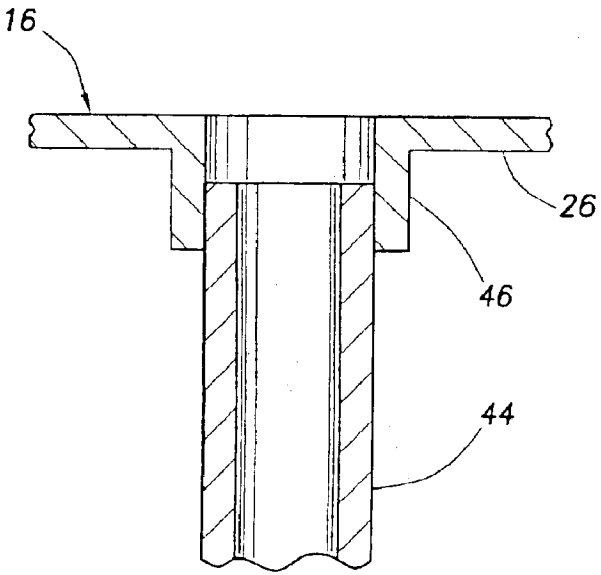
FIGS. 5A & B are enlarged scale cross-sectional views of a third method of attaching a liner to the wellbore junction.

Another method of connecting a liner string 44 to the structure 16 is representatively illustrated in FIGS. 5A & B. In this method, the bottom wall 26 of the structure 16 is provided with an outwardly extending tubular portion 46. After the corresponding branch wellbore 24 is drilled, the liner string 44 is positioned in the branch wellbore, so that an upper end of the liner string is within the tubular portion 46, as depicted in FIG. 5A.

Figure 5B:
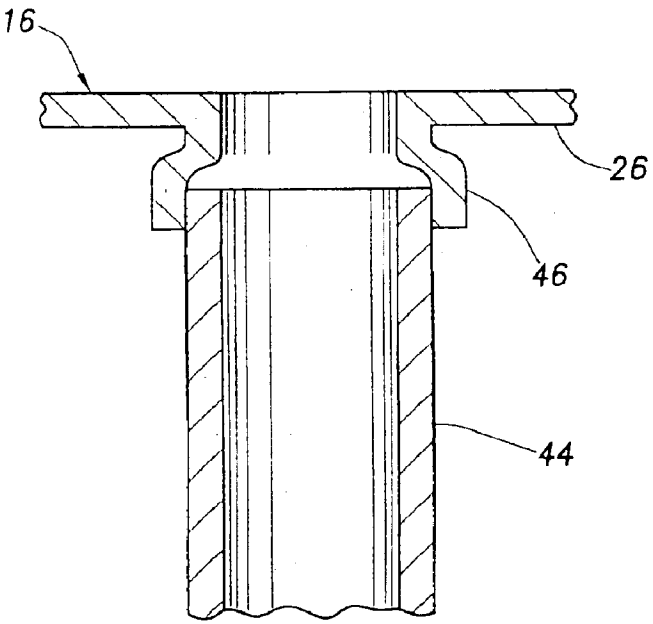

The liner string 44 is then expanded, as depicted in FIG. 5B. Expansion of the liner string 44 also causes expansion of the tubular portion 46, in a manner similar to that in which the tubular portion 42 of the bushing 40 is expanded as described above and illustrated in FIG. 4B. Preferably, this expansion of the liner string 44 secures the liner string to the structure 16, and forms a seal therebetween.

Note that the method depicted in FIGS. 5A & B eliminates the step of installing the bushing 40 in the bottom wall 26, since the tubular portion 46 is integrally formed on the bottom wall of the structure 16. However, the tubular portion 46 is vulnerable to damage due to the cutting tools and other equipment passing therethrough while the wellbore 24 is being drilled. For this reason, it may be desirable to install the bushing 40 in the bottom wall 26 of the structure 16 as depicted in FIGS. 5A & B, so that the tubular portion 46 is protected from damage during the drilling process. Thus, the bushing 40 may serve as a wear bushing which is removed after the drilling process and prior to installing the liner string 44.

Figure 6A:
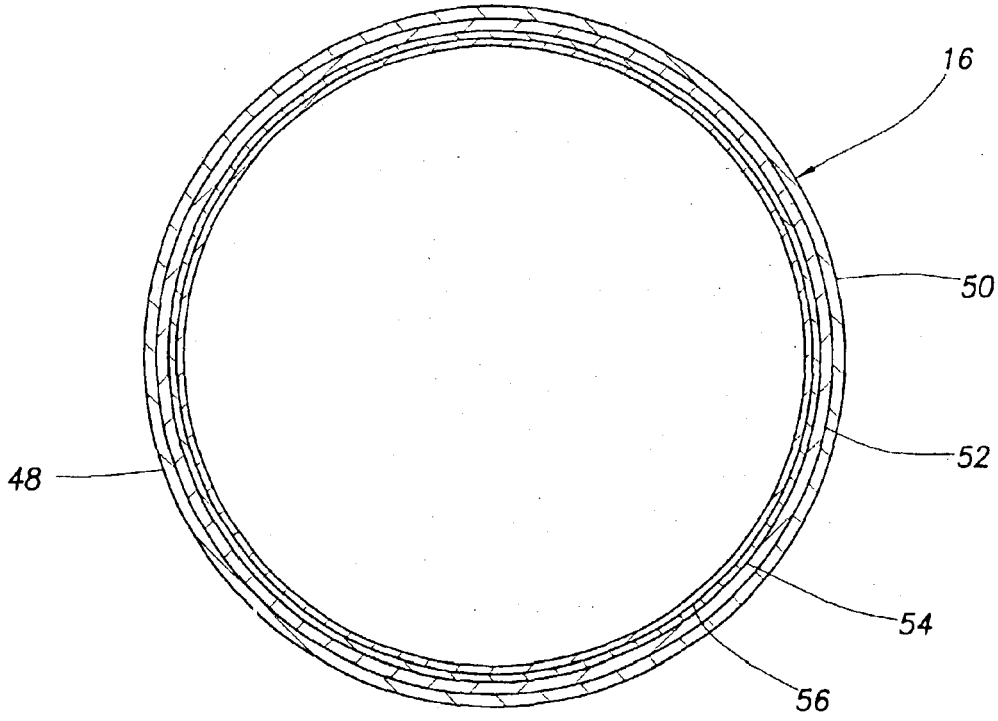
FIGS. 6A & B are enlarged scale cross-sectional views of a method of compressing and expanding the wellbore junction.
Figure 6B:
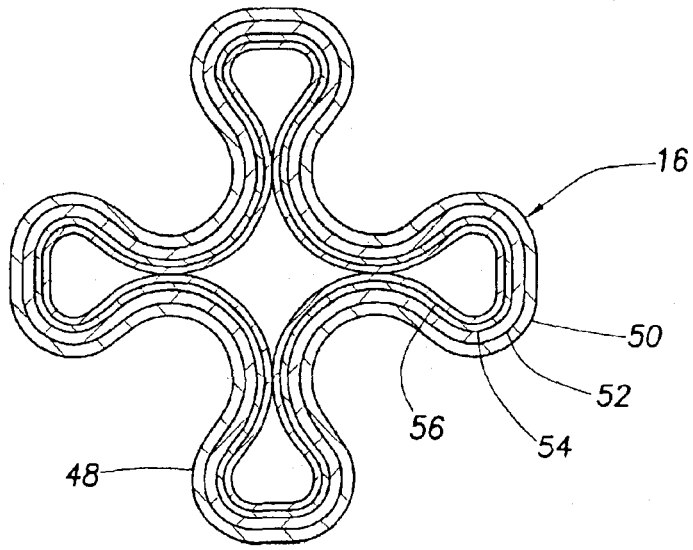

Referring additionally now to FIGS. 6A & B, a cross-sectional view of the structure 16 is representatively illustrated, taken along line 6—6 of FIG. 1A. In FIG. 6A, the structure 16 is depicted in its initial and expanded configurations. In FIG. 6B, the structure 16 is depicted in its unexpanded configuration.

As mentioned above, the structure 16 may be fabricated in an initial configuration (FIG. 6A), and then compressed into an unexpanded configuration (FIG. 6B). After positioning in the wellbore 12, the structure 16 is then expanded, so that it resumes its initial configuration, which is also its expanded configuration (FIG. 6A). Alternatively, the structure 16 could be initially fabricated in its unexpanded configuration (FIG. 6B), and then expanded to its expanded configuration (FIG. 6A).

In its unexpanded configuration, a sidewall 48 of the structure 16 is subjected to multiple fairly small radius folds, so that the structure has a "cloverleaf" shape, i.e., the sidewall is circumferentially corrugated. As depicted in FIG. 6B, the sidewall 48 has four outer lobes or corrugations. However, it should be understood that any number of corrugations may be used, and the sidewall 48 may have any shape, in keeping with the principles of the invention.

If the sidewall 48 were made up of only a single thickness of material, a relatively large amount of elongation of the material would be required at the radii of the folds or corrugations. Since shear stresses due to the bending of the material would be transmitted through the entire thickness of the material, the convex side of a fold would be in tension while a concave side of the fold would be in compression. The thicker the material in the sidewall 48, the greater the tension and compression produced by the radii of the folds or corrugations.

It would be beneficial to reduce the amount of elongation produced in the sidewall 48 material. This would reduce any coldworking of the material produced when the structure 16 is compressed and expanded, reduce the forces needed to compress and expand the structure, expand the range of materials which may be used (i.e., including materials having lower elongation limits), and would provide other benefits.

Accordingly, the sidewall 48 is preferably made up of multiple layers 50, 52, 54, 56. Although four layers are depicted in FIGS. 6A & B, any number of layers may be used. The layers 50, 52, 54, 56 are preferably each made of steel or another metal, although other materials may be used, in keeping with the principles of the invention.

The layers 50, 52, 54, 56 are initially free to displace relative to one another, so that shear forces due to expanding and compressing the structure 16 are not transmitted between the layers (other than via friction between the layers). Thus, significantly less elongation of each layer 50, 52, 54, 56 is required in compressing and expanding the sidewall 48 as compared to a single-thickness sidewall.

However, transmission of shear forces between the layers 50, 52, 54, 56 is desirable once the structure 16 has been expanded, in order to resist forces tending to collapse the structure. As will be appreciated by one skilled in the art, transmission of shear forces between the layers 50, 52, 54, 56 will provide greater resistance to bending of the sidewall 48, and will thereby aid in maintaining the structure 16 in its expanded configuration.

In order to enable transmission of shear forces between the layers 50, 52, 54, 56 after expansion of the structure 16, the layers may be bonded or mechanically interlocked to each other during and/or after the expansion process. FIGS. 7–10 representatively illustrate various methods of accomplishing this result. However, it should be clearly understood that other methods may be used, without departing from the principles of the invention.

Figure 7:
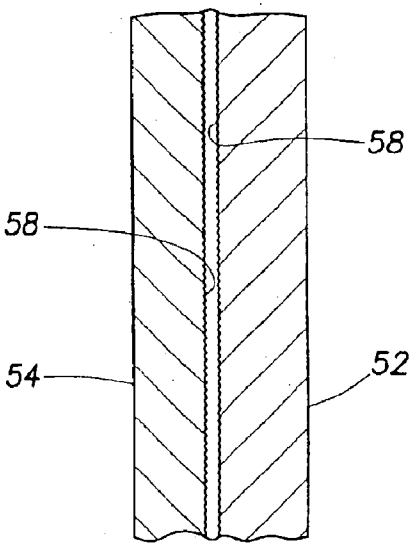

In FIG. 7, interlocking profiles 58 are formed on facing surfaces of the layers 52, 54. These profiles 58 may be ridges, grooves, ramps, dovetails, tongues and grooves, etc., or any other type of profile which may serve to transmit a shear force between the layers 52, 54. The profiles 58 may serve to substantially increase friction between the layers 52, 54 when the structure 16 is expanded.

In the initial or unexpanded configuration of the structure 16, the profiles 58 may be spaced apart, the profiles subsequently engaging each other when the structure is expanded. Alternatively, the profiles 58 may be configured so that, although they are initially in contact with each other, they do not transmit shear forces between the layers 52, 54 until the structure 16 is expanded. Any other method of mechanically interlocking the layers 52, 54 to each other may be used, in keeping with the principles of the invention.

Figure 8:
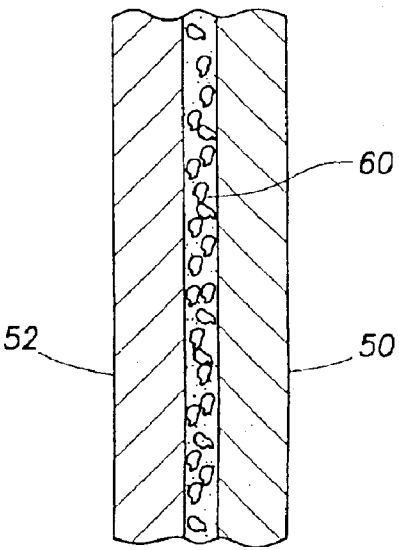
FIGS. 7–10 are enlarged scale cross-sectional views of alternate methods of transmitting shear forces between adjacent layers of the wellbore junction.

In FIG. 8, a granular material 60, such as an aggregate or a crystalline material, is positioned between the layers 50, 52. The material 60 substantially increases friction between the layers 50, 52, so that the layers are interlocked when the structure 16 is expanded.

Figure 9:
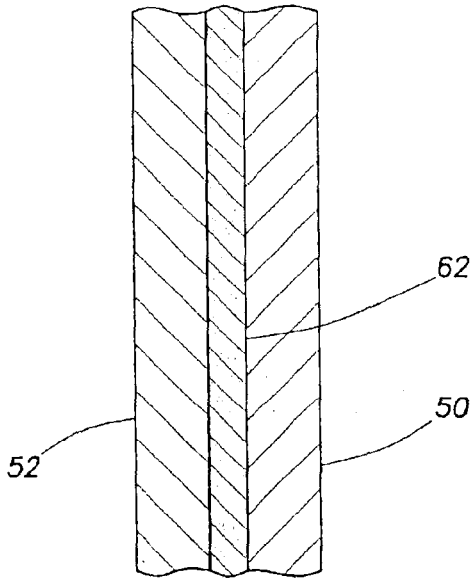

In FIG. 9, an adhesive or chemical bond 62 prevents relative displacement between the layers 50, 52. The adhesive 62 may be positioned between the layers 50, 52 either before or after expansion of the structure 16. For example, the adhesive 62 could be a thermally-activated adhesive which is positioned between the layers 50, 52 prior to expansion. After expansion, a heat source is positioned within the structure 16 to activate the adhesive 62 to bond the layers 50, 52 to each other.

As another example, the layers 50, 52 could be spaced apart after expansion of the structure 16. The adhesive 62 (for example, an epoxy) could then be pumped between the layers 50, 52 and allowed to harden. Any other method of adhering or bonding the layers 50, 52 to each other may be used, in keeping with the principles of the invention.

Figure 10:
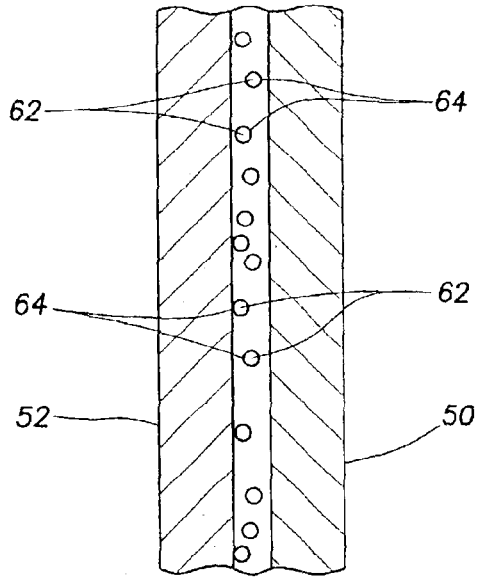

In FIG. 10, the adhesive 62 is initially contained within frangible beads or capsules 64 positioned between the layers 50, 52. For example, the capsules 64 could be made of glass or a ceramic material. The layers 50, 52 would initially be spaced apart.

When the structure 16 is expanded, the layers 50, 52 are displaced toward each other, thereby breaking the capsules 64 and releasing the adhesive 62 from the capsules. The adhesive 62 then bonds the layers 50, 52 to each other. Any other method of releasing an adhesive between the layers 50, 52 during or after the expansion process may be used, in keeping with the principles of the invention. For example, use of capsules which are thermally- or time-activated/degraded, or use of thermally- or time-activated adhesives, such as epoxies.

Alternatively, the adhesive 62 could initially be external to the capsules 64 in the space between the layers 50, 52. In this case, the capsules 64 could contain an adhesive system component, such as a catalyst or hardening agent for the adhesive 62. When the capsules 64 are broken by displacement of the layers 50, 52, the catalyst or hardening agent could then come into contact with the adhesive 62, thereby causing the adhesive to harden or otherwise bond the layers to each other.

Furthermore, other methods may be used to increase the collapse resistance of the expanded structure 16. For example, one or more inner layers (e.g., layers 54, 56) may be yielded during the expansion process, without yielding one or more outer layers (e.g., layers 50, 52), or at least yielding of the inner layer(s) may be greater than yielding of the outer layer(s). This would produce residual hoop or circumferential compression in the inner layer(s) and residual hoop or circumferential tension in the outer layer(s).

This result may be accomplished by any of a variety of methods. For example, the inner layer(s) may be made thinner than the outer layer(s), as depicted in FIGS. 6A & B, so that greater hoop stress is generated in the inner layer(s) during the expansion process. Alternatively, the inner layer (s) may be made of a material having a lower yield strength than the outer layer(s). As another alternative, the layers may have different moduli of elasticity, or other different material properties. In this case, it may be desirable to make the inner layer(s) thicker than the outer layer(s).

However, it should be understood that the layers may have any relationship between their thicknesses as desired, or as dictated by the material properties of the layers an their desired condition after expansion. For example, one layer may be made of a material selected for its corrosion resistance or other property substantially unrelated to its strength or stress condition after expansion, in which case the layer may be made thinner or thicker than any other layer.

There may be cases where it is advantageous to "crush" or deform the structure 16 and then bond the layers 50, 52, 54, 56 together prior to running the structure into the well. In this manner, the structure 16 would be easier to manufacture because it would require less horsepower to deform to its compressed or unexpanded configuration. For instance, the crushed or unexpanded configuration could be made by physically compressing/crushing or drawing.

After the layers 50, 52, 54, 56 are drawn/crushed, they could be assembled and then fastened together to prevent the layers from moving relative to one another. The downhole inflation/expansion forces would be higher, but that can be worked around by using high-pressure intensifiers (e.g., the drill pipe pressure may be increased significantly to inflate the structure downhole). The strains may be low enough that the structure 16 can be reinflated as a structure of one wall thickness, instead of as a multilayer structure. This would eliminate the complexity of bonding or otherwise securing the layers 50, 52, 54, 56 together downhole.

Figure 11:
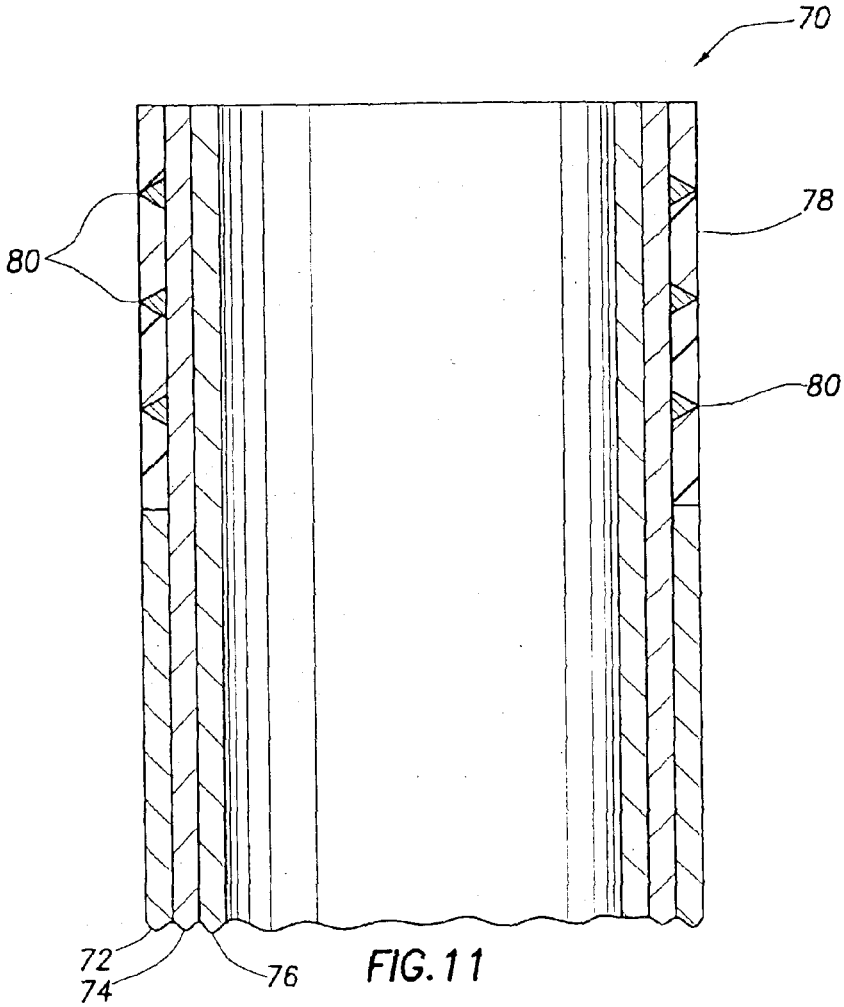
FIG. 11 is a schematic cross-sectional view of a liner hanger embodying principles of the present invention.

Referring additionally now to FIG. 11, another expandable structure 70 incorporating principles of the present invention is representatively illustrated. The structure 70 is a liner hanger which may be used at the top end of the liner string 38 depicted in FIG. 4B, or at the top end of the liner string 44 depicted in FIG. 5B, to attach and seal the liner string to the structure 16.

The liner hanger 70 includes multiple layers 72, 74, 76 which are initially substantially free to expand or compress without transmitting shear forces between the layers. The liner hanger 70 is conveyed into the well in a compressed or unexpanded configuration, and then expanded downhole, for example, as depicted in FIGS. 4B & 5B. After expansion, the layers 72, 74, 76 are bonded or adhered to each other, or mechanically interlocked, etc., as described above for the layers 50, 52, 54, 56 of the structure 16, so that the layers 72, 74, 76 then transmit shear forces therebetween and/or relative displacement between the layers is prevented, or at least substantially resisted.

During expansion, an outer layer 72 or 74 may be yielded to an extent greater than that of an inner layer 74 or 76, so that residual tensile hoop stress remains in an outer layer and residual compressive hoop stress remains in an inner layer after the expansion process is completed. In addition, the layers 72, 74, 76 may have different material properties, different thicknesses, etc., as described above for the layers 50, 52, 54, 56 of the structure 16.

To enhance sealing between the expanded liner hanger 70 and the tubular member 42, 46 in which it is expanded, the liner hanger preferably includes a sealing material 78. The sealing material 78 may be configured as a part of the outer layer 72, as depicted in FIG. 11, or it may be separately attached externally on the outer layer 72. The sealing material 78 may be an elastomer, such as a nitrile or fluorocarbon material, it may be a nonelastomer, such as PTFE or PEEK material, or it may be a metal, such as lead, etc.

Thus, it should be understood that any type of sealing material 78 may be used in the liner hanger 70, in keeping with the principles of the invention. The sealing material 78 could be incorporated into the outer layer 72, for example, by providing the outer layer made of a composite material.

To enhance gripping engagement between the expanded liner hanger 70 and the tubular member 42, 46 in which it is expanded, the liner hanger preferably includes grip members or slips 80. As depicted in FIG. 11, the grip members 80 are triangular in cross-section and are embedded in the sealing material 78. However, it should be clearly understood that these details are not necessary in keeping with the principles of the invention, since the grip members 80 could be otherwise shaped or otherwise positioned on the liner hanger 70.

Although separate sealing material 78 and grip members 80 have been illustrated in FIG. 11, it will be readily appreciated that it is not necessary to provide separate structures to perform the functions of these elements. For example, the grip members 80 could seal against the tubular member 42, 46 in which the liner hanger 70 is expanded (such as, by metal-to-metal contact between the grip members and the interior of the tubular member), and the sealing material 78 could grip the tubular member in which the liner hanger is expanded (such as by friction between the sealing material and the interior of the tubular member).

Of course, a person skilled in the art would, upon a careful consideration of the above description of representative embodiments of the invention, readily appreciate that many modifications, additions, substitutions, deletions, and other changes may be made to these specific embodiments, and such changes are contemplated by the principles of the present invention. Accordingly, the foregoing detailed description is to be clearly understood as being given by way of illustration and example only, the spirit and scope of the present invention being limited solely by the appended claims and their equivalents.

What is claimed is:

1. A method of expanding a structure in a wellbore of a subterranean well, the method comprising the steps of:

positioning the structure in an unexpanded configuration in the wellbore, the structure including a wall made up of multiple layers;

expanding the structure to an expanded configuration in the wellbore, the expanding step including yielding at least one inner layer of the wall to a greater extent than at least one outer layer of the wall is yielded; and increasing shear force transmission between the layers after the positioning and expanding steps.

2. The method according to claim 1, further comprising the step of collapsing the structure from an initial configuration to the unexpanded configuration prior to the positioning step.

3. The method according to claim 1, wherein the expanding step further comprises permitting the layers to displace relative to each other, and wherein the shear force transmission increasing step further comprises increasing resistance to relative displacement between the layers.

4. The method according to claim 1, wherein the shear force transmission increasing step further comprises mechanically interlocking the layers to each other.

5. The method according to claim 1, wherein the shear force transmission increasing step further comprises chemically bonding the layers to each other.

6. The method according to claim 1, wherein the shear force transmission increasing step further comprises adhesively bonding the layers to each other.

7. The method according to claim 1, wherein the shear force transmission increasing step further comprises placing between the layers frangible capsules containing a selected one of an adhesive and an adhesive system component.

8. The method according to claim 7, wherein the shear force transmission increasing step further comprises releasing the selected one of the adhesive and the adhesive system component from the capsules.

9. The method according to claim 8, wherein the releasing step is performed in response to the expanding step.

10. The method according to claim 1, wherein the shear force transmission increasing step further comprises applying heat to a thermally activated adhesive disposed between the layers.

11. The method according to claim 1, wherein the expanding step further comprises applying an outwardly directed expansion force to the wall.

12. The method according to claim 11, wherein the expanding step further comprises applying pressure to an interior of the structure.

13. The method according to claim 11, further comprising the step of producing circumferential tension in at least one outer layer of the wall and circumferential compression in at least one inner layer of the wall when the expansion force is removed.

14. The method according to claim 1, further comprising the step of connecting a cementing shoe to the structure prior to the positioning step.

15. The method according to claim 1, wherein in the positioning step, the layers are spaced apart from each other.

16. The method according to claim 1, further comprising the step of disposing an adhesive between the layers after the positioning step.

17. The method according to claim 16, wherein the shear force transmission increasing step is performed after the adhesive disposing step.

18. The method according to claim 1, wherein at least one outer layer of the wall has a thickness greater than at least one inner layer of the wall.

19. The method according to claim 1, wherein at least one inner layer of the wall has a thickness greater than at least one outer layer of the wall.

20. The method according to claim 1, wherein the expanding step further comprises sealingly engaging a sealing material on the structure with an interior of a tubular member in which the structure is expanded.

21. The method according to claim 1, wherein the expanding step further comprises grippingly engaging a grip member on the structure with an interior of a tubular member in which the structure is expanded.

22. A method of expanding a structure in a wellbore of a subterranean well, the method comprising the steps of:

positioning the structure in an unexpanded configuration in the wellbore, the structure including a wall made up of multiple layers;

expanding the structure to an expanded configuration in the wellbore;

increasing shear force transmission between the layers after the positioning and expanding steps; and drilling at least one branch wellbore through the structure after the expanding step.

23. The method according to claim 22, further comprising the step of installing a wear bushing in the structure prior to the drilling step.

24. The method according to claim 22, further comprising the step of connecting a liner string to the structure after the drilling step, the liner extending into the branch wellbore.

25. The method according to claim 24, wherein the connecting step further comprises expanding at least a portion of the liner string.

26. A method of expanding a structure in a wellbore of a subterranean well, the method comprising the steps of:

positioning the structure in an unexpanded configuration in the wellbore, the structure including a wall made up of multiple layers;

expanding the structure to an expanded configuration in the wellbore;

increasing shear force transmission between the layers after the positioning and expanding steps; and providing the structure wherein different layers of the wall have different yield strengths.

27. A method of expanding a structure in a wellbore of a subterranean well, the method comprising the steps of:

positioning the structure in an unexpanded configuration in the wellbore, the structure including a wall made up of multiple layers;

expanding the structure to an expanded configuration in the wellbore;

increasing shear force transmission between the layers after the positioning and expanding steps; and providing the structure wherein different layers of the wall have different moduli of elasticity.

28. A method of expanding a structure in a wellbore of a subterranean well, the method comprising the steps of:

positioning the structure in an unexpanded configuration in the wellbore, the structure including a wall made up of multiple layers;

expanding the structure to an expanded configuration in the wellbore;

increasing shear force transmission between the layers after the positioning and expanding steps; and wherein the structure is a liner hanger, and wherein the expanding step further comprises sealing and securing a liner string to a tubular member in the wellbore.

29. A method of expanding a structure in a wellbore of a subterranean well, the method comprising the steps of:

positioning the structure in an unexpanded configuration in the wellbore, the structure including a wall made up of multiple layers;

expanding the structure to an expanded configuration while permitting relative displacement between the layers; and then increasing resistance to relative displacement between the layers by positioning an adhesive between the layers after the structure positioning step, and adhering the layers to each other.

30. The method according to claim 29, wherein the adhesive positioning step further comprises containing an adhesive system component within capsules disposed between the layers.

31. The method according to claim 30, wherein the expanding step further comprises releasing the adhesive system component from within the capsules.

32. The method according to claim 29, wherein the adhesive is thermally activated, and wherein the adhering step further comprises applying heat to the adhesive.

33. The method according to claim 29, wherein the increasing resistance step is performed by mechanically interlocking the layers to each other.

34. The method according to claim 33, wherein the interlocking step further comprises forming interlocking profiles on facing surfaces of the layers.

35. The method according to claim 33, wherein the interlocking step further comprises increasing friction between facing surfaces of the layers.

36. The method according to claim 29, wherein the increasing resistance step further comprises chemically bonding the layers to each other.

37. The method according to claim 29, wherein the increasing resistance step further comprises adhesively bonding the layers to each other.

38. The method according to claim 29, further comprising the step of collapsing the structure from an initial configuration to the unexpanded configuration prior to the positioning step.

39. The method according to claim 29, wherein the expanding step further comprises yielding at least one inner layer of the wall to an extent greater than that in at least one outer layer of the wall.

40. The method according to claim 29, wherein the expanding step further comprises applying an outwardly directed expansion force to the wall.

41. The method according to claim 40, wherein the expanding step further comprises applying pressure to an interior of the structure.

42. The method according to claim 40, further comprising the step of producing circumferential tension in at least one outer layer of the wall and circumferential compression in at least one inner layer of the wall when the expansion force is removed.

43. The method according to claim 29, further comprising the step of connecting a cementing shoe to the structure prior to the positioning step.

44. The method according to claim 29, wherein in the positioning step, the layers are spaced apart from each other.

45. The method according to claim 29, wherein at least one outer layer of the wall has a thickness greater than at least one inner layer of the wall.

46. The method according to claim 29, wherein at least one inner layer of the wall has a thickness greater than at least one outer layer of the wall.

47. The method according to claim 29, wherein the expanding step further comprises sealingly engaging a sealing material on the structure with an interior of a tubular member in which the structure is expanded.

48. The method according to claim 29, wherein the expanding step further comprises grippingly engaging a grip member on the structure with an interior of a tubular member in which the structure is expanded.

49. A method of expanding a structure in a wellbore of a subterranean well, the method comprising the steps of:

positioning the structure in an unexpanded configuration in the wellbore, the structure including a wall made up of multiple layers;

expanding the structure to an expanded configuration while permitting relative displacement between the layers; and then increasing resistance to relative displacement between the layers by mechanically interlocking the layers to each other, the interlocking step including positioning a friction increasing granular material between the layers.

50. A method of expanding a structure in a wellbore of a subterranean well, the method comprising the steps of:

positioning the structure in an unexpanded configuration in the wellbore, the structure including a wall made up of multiple layers;

expanding the structure to an expanded configuration while permitting relative displacement between the layers;

then increasing resistance to relative displacement between the layers; and drilling at least one branch wellbore through the structure after the expanding step.

51. The method according to claim 50, further comprising the step of installing a wear bushing in the structure prior to the drilling step.

52. The method according to claim 50, further comprising the step of connecting a liner string to the structure after the drilling step, the liner extending into the branch wellbore.

53. The method according to claim 52, wherein the connecting step further comprises expanding at least a portion of the liner string.

54. A method of expanding a structure in a wellbore of a subterranean well, the method comprising the steps of:

positioning the structure in an unexpanded configuration in the wellbore, the structure including a wall made up of multiple layers;

expanding the structure to an expanded configuration while permitting relative displacement between the layers;

then increasing resistance to relative displacement between the layers; and providing the structure wherein different layers of the wall have different yield strengths.

55. A method of expanding a structure in a wellbore of a subterranean well, the method comprising the steps of:

positioning the structure in an unexpanded configuration in the wellbore, the structure including a wall made up of multiple layers;

expanding the structure to an expanded configuration while permitting relative displacement between the layers;

then increasing resistance to relative displacement between the layers; and providing the structure wherein different layers of the wall have different moduli of elasticity.

56. A method of expanding a structure in a wellbore of a subterranean well, the method comprising the steps of:

positioning the structure in an unexpanded configuration in the wellbore, the structure including a wall made up of multiple layers;

expanding the structure to an expanded configuration while permitting relative displacement between the layers;

then increasing resistance to relative displacement between the layers; and wherein the structure is a liner hanger, and wherein the expanding step further comprises sealing and securing a liner string to a tubular member in the wellbore.

57. A system for expanding a structure in a wellbore of a subterranean well, the system comprising:

the structure including a wall having multiple layers, the structure being expanded from an unexpanded configuration to an expanded configuration by initially permitting substantially unimpeded relative displacement between the layers, and then increasing resistance to relative displacement between the layers, and wherein at least one outer layer of the wall is in circumferential tension, and at least one inner layer of the wall is in circumferential compression, when the structure is in its expanded configuration.

58. The system according to claim 57, further comprising an adhesive positioned between the layers, the adhesive preventing relative displacement between the layers when the structure is in the expanded configuration.

59. The system according to claim 58, wherein an adhesive system component is released from within capsules positioned between the layers when the structure is expanded.

60. The system according to claim 58, wherein the adhesive is thermally activated by applying heat to the adhesive after the structure is expanded.

61. The system according to claim 57, wherein the layers are mechanically interlocked to each other when the structure is expanded.

62. The system according to claim 57, wherein at least one inner layer of the wall is yielded to an extent greater than that of at least one outer layer of the wall, when the structure is expanded.

63. The system according to claim 57, wherein at least one outer layer of the wall has a thickness greater than at least one inner layer of the wall.

64. The method according to claim 57, wherein at least one inner layer of the wall has a thickness greater than at least one outer layer of the wall.

65. A system for expanding a structure in a wellbore of a subterranean well, the system comprising:

the structure including a wall having multiple layers, the structure being expanded from an unexpanded configuration to an expanded configuration by initially permitting substantially unimpeded relative displacement between the layers, and then increasing resistance to relative displacement between the layers, and wherein different layers of the wall have different yield strengths.

66. A system for expanding a structure in a wellbore of a subterranean well, the system comprising:

the structure including a wall having multiple layers, the structure being expanded from an unexpanded configuration to an expanded configuration by initially permitting substantially unimpeded relative displacement between the layers, and then increasing resistance to relative displacement between the layers, and wherein different layers of the wall have different moduli of elasticity.

67. A method of expanding a structure in a wellbore of a subterranean well, the method comprising the steps of:

providing the structure having a wall made up of multiple layers;

deforming the structure into an unexpanded configuration while permitting relative displacement between the layers;

then increasing resistance to relative displacement between the layers;

then positioning the structure in the unexpanded configuration in the wellbore; and expanding the structure to an expanded configuration in the wellbore.

68. The method according to claim 67, wherein the increasing resistance step is performed by adhering the layers to each other.

69. The method according to claim 68, wherein the adhering step further comprises positioning an adhesive between the layers.

70. The method according to claim 69, wherein the adhesive positioning step is performed after the deforming step.

71. The method according to claim 69, wherein the adhesive positioning step further comprises containing an adhesive system component within capsules disposed between the layers.

72. The method according to claim 71, wherein the deforming step further comprises releasing the adhesive system component from within the capsules.

73. The method according to claim 69, wherein the adhesive is thermally activated, and wherein the adhering step further comprises applying heat to the adhesive.

74. The method according to claim 67, wherein the increasing resistance step is performed by mechanically interlocking the layers to each other.

75. The method according to claim 74, wherein the interlocking step further comprises forming interlocking profiles on facing surfaces of the layers.

76. The method according to claim 74, wherein the interlocking step further comprises increasing friction between facing surfaces of the layers.

77. The method according to claim 74, wherein the interlocking step further comprises positioning a friction increasing granular material between the layers.

78. The method according to claim 67, wherein the increasing resistance step further comprises chemically bonding the layers to each other.

79. The method according to claim 67, wherein the increasing resistance step further comprises adhesively bonding the layers to each other.

80. The method according to claim 67, wherein the deforming step further comprises collapsing the structure from an initial configuration to the unexpanded configuration.

* * * * *